US009441927B1

(12) United States Patent
Huang

(10) Patent No.: US 9,441,927 B1
(45) Date of Patent: Sep. 13, 2016

(54) FIELD POINTS FOR DOUBLE WALLED ARROW SHAFTS

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 0 days.

(21) Appl. No.: 15/070,137

(22) Filed: Mar. 15, 2016

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 6,027,421 A * 2/2000 Adams, Jr. ..... F42B 6/08 473/578
7,115,055 B2 * 10/2006 Palomaki ..... F42B 6/08 473/578
7,485,056 B2 * 2/2009 Sullivan ..... F42B 6/08 473/583
7,811,186 B2 * 10/2010 Palomaki ..... F42B 6/08 473/578
8,057,330 B2 * 11/2011 Blosser ..... F42B 6/04 473/582
8,337,342 B1 12/2012 Huang
8,403,777 B1 3/2013 Huang
8,460,134 B2 * 6/2013 Palomaki ..... F42B 6/08 473/582
9,068,804 B2 * 6/2015 McPherson ..... F42B 6/06
9,366,510 B1 * 6/2016 Zobell ..... F42B 6/04

* cited by examiner

*Primary Examiner* — John Ricci
(74) *Attorney, Agent, or Firm* — Donald J. Ersler

(57) ABSTRACT

A field point for a double walled arrow shaft preferably includes a target point formed on one end and a weight reduction cavity formed in an opposing end thereof. The double walled arrow shaft includes an outer tube and an inner tube. An outer tube diameter is formed in substantially a middle of the field point to receive an inner diameter of an outer tube of the double walled arrow shaft. An end of the inner tube diameter is formed adjacent the first shaft diameter and between an end of the outer tube diameter and the opposing end of the field point to receive an inner diameter of an inner tube of the double walled arrow shaft. An end of the outer tube diameter is terminated with an outer undercut. An end of the outer tube is chamfered or tapered to be received by the outer undercut.

17 Claims, 4 Drawing Sheets

FIELD POINTS FOR DOUBLE WALLED ARROW SHAFTS

BACKGROUND OF THE INVENTION

1. Field of the Invention

The present invention relates generally to archery and more specifically to field points for double walled arrow shafts, which do not require an arrow insert to prevent damage to an end of an arrow shaft during use.

2. Discussion of the Prior Art

Arrow inserts are typically used to retain a field point in an arrow shaft. The field point is screwed into the arrow insert. The arrow insert is used to prevent damage to an end of the arrow shaft, when the arrow strikes a target. Large diameter arrow shafts necessitate a larger and heavier arrow insert. However, it appears that the prior art does not disclose a field point that eliminates the need for an arrow insert when using a double walled arrow shaft. U.S. Pat. No. 8,337,342 to Huang discloses a hybrid arrow insert. U.S. Pat. No. 8,403,777 to Huang discloses an arrow insert with an undercut head.

Accordingly, there is a clearly felt need in the art for field points for double walled arrow shafts, which do not require an arrow insert; and which result in a reduced overall weight of a large diameter arrow shaft.

SUMMARY OF THE INVENTION

The present invention provides field points for double walled arrow shafts, which result in a reduced overall weight of a large diameter arrow shaft. A field point for a double walled arrow shaft (field point) preferably includes a target point formed on one end and a weight reduction cavity formed in an opposing end thereof. The weight reduction cavity includes a bullet shaped end, which is shaped to give the field point a substantially uniform wall thickness. The double walled arrow shaft includes an outer tube and an inner tube. An end of the inner tube is located inside the outer tube, such that the end of the inner tube is recessed inside the outer tube. An outer tube diameter is formed in substantially a middle of the field point to receive an inner diameter of an outer tube of the double walled arrow shaft. An end of an inner tube diameter is formed adjacent an end of the first shaft diameter and between the end of the outer tube diameter and the opposing end of the field point to receive an inner diameter of an inner tube of the double walled arrow shaft. The end of the outer tube diameter is terminated with an outer undercut. An end of the outer tube of the double walled arrow shaft is chamfered or tapered to be received by the outer undercut. A second embodiment of the field point includes the outer undercut and terminating the end of the inner tube diameter with an inner undercut. The end of the inner tube of the double walled arrow shaft is chamfered or tapered to be received by the inner undercut. A third embodiment of the field point does not include the outer undercut and the inner undercut. The end of the outer tube diameter and the inner tube diameter are substantially perpendicular to a lengthwise axis of the field point. A fourth embodiment of the field point includes only an inner tube diameter, which is sized to receive an inner diameter of the inner tube of a double walled arrow shaft. An end of the inner tube diameter is terminated with a single undercut. The end of the inner and outer tubes are chamfered or tapered to be received by the single undercut.

Accordingly, it is an object of the present invention to provide a field point, which does not require an arrow insert.

Finally, it is another objection of the present invention to provide a field point, which results in a reduced overall weight of a large diameter arrow shaft.

These and additional objects, advantages, features and benefits of the present invention will become apparent from the following specification.

DETAILED DESCRIPTION OF THE PREFERRED EMBODIMENTS

Figure 1:
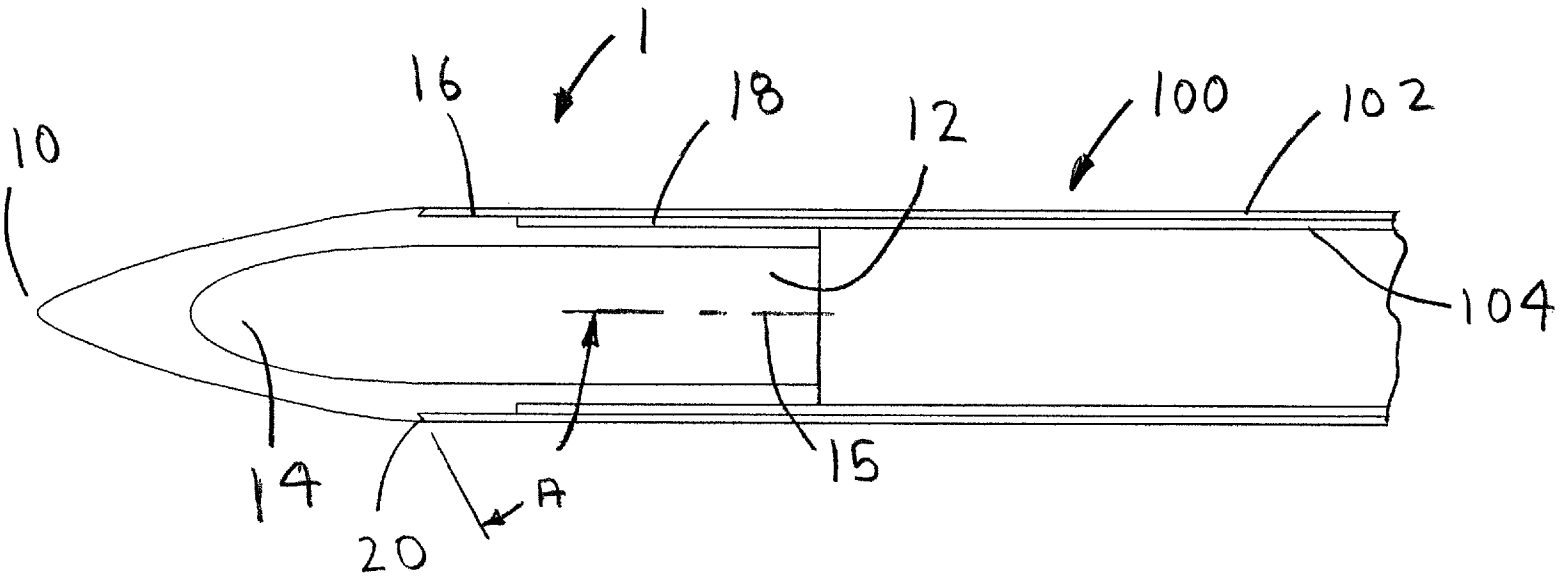
FIG. 1 is a cross sectional view of a field in accordance with the present invention.

With reference now to the drawings, and particularly to FIG. 1, there is shown a field point 1 retained in a double walled arrow shaft 100. The field point 1 preferably includes a target point 10 formed on one end and a weight reduction cavity 12 formed in an opposing end thereof. The weight reduction cavity 12 includes a bullet shaped end 14, which is shaped to give the field point 1 a substantially uniform wall thickness. A length of the weight reduction cavity 12 extends substantially all of a length of the field point 1. The double walled arrow shaft 100 includes an outer tube 102 and an inner tube 104. An end of the inner tube 104 is located inside the outer tube 102, such that the end of the inner tube 104 is recessed inside the outer tube 102. An outer tube diameter 16 is formed on the field point 1 starting at substantially a middle of the field point 1 to receive an inner diameter of an outer tube 102 of a double walled arrow shaft 100. An end of an inner tube diameter 18 is formed on the outer tube diameter 16 starting adjacent an end of the outer tube diameter 16 and between the end of the outer tube diameter 16 and the opposing end of the field point 1 to receive an inner diameter of the inner tube 104 of the double walled arrow shaft 100. The end of the outer tube diameter 16 is terminated with an outer undercut 20. The outer undercut 20 forms an acute angle "A" with a lengthwise axis 15 of the field point 1. The acute angle "A" is preferably 45 degrees, but other acute angles may also be used. An end of the outer tube 102 of the double walled arrow shaft 100 is chamfered or tapered to be received by the outer undercut 20 to substantially match angle "A."

Figure 2:
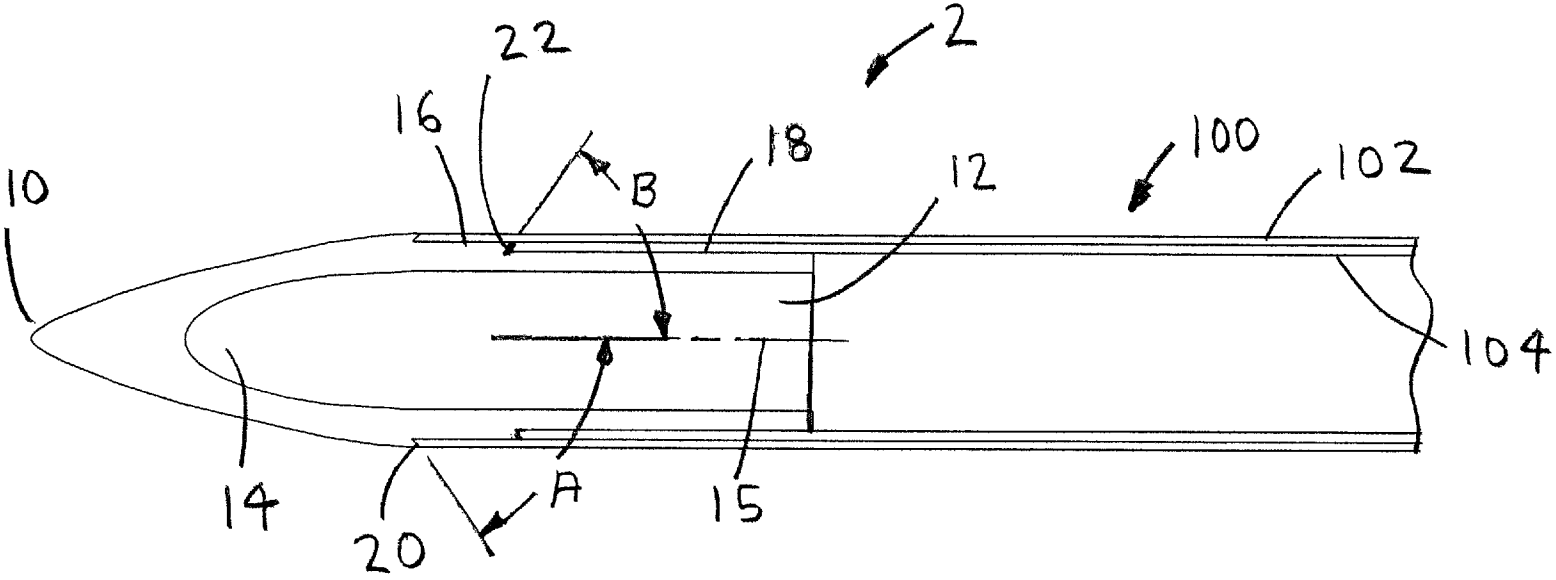
FIG. 2 is a cross sectional view of a second embodiment of a field point in accordance with the present invention.
Figure 3:
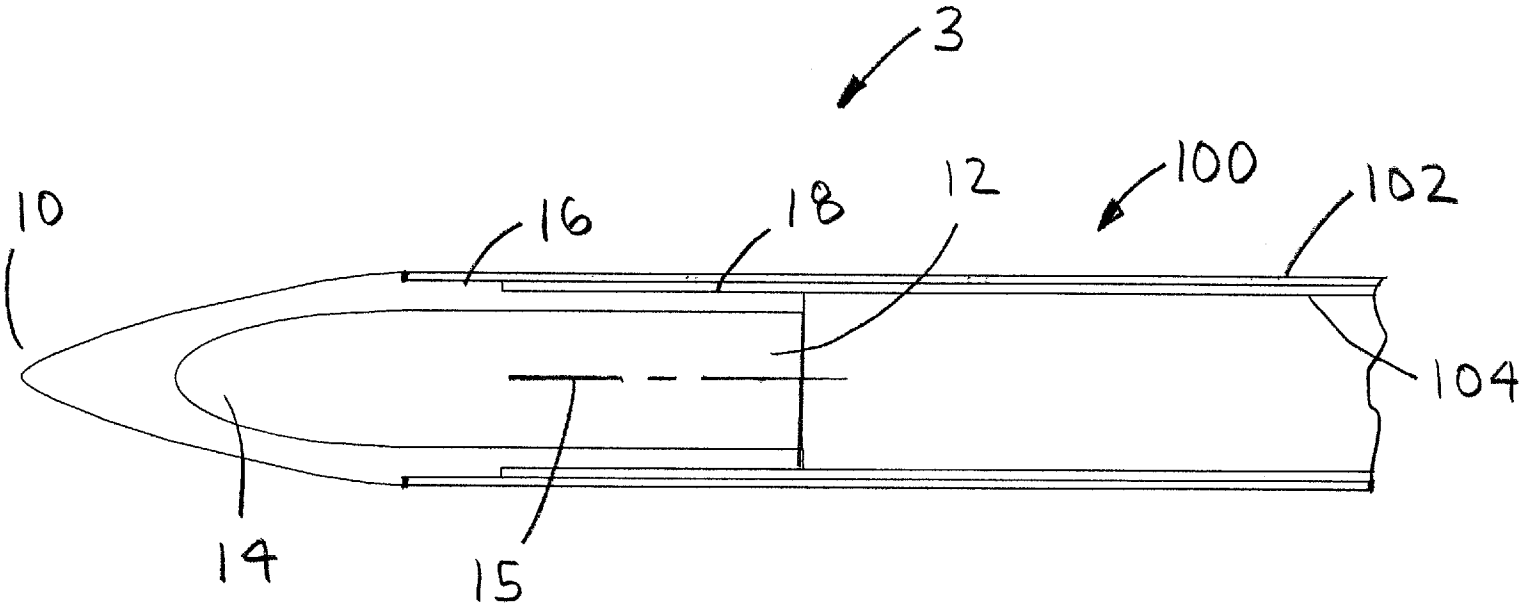
FIG. 3 is a cross sectional view of a third embodiment of a field point in accordance with the present invention.
Figure 4:
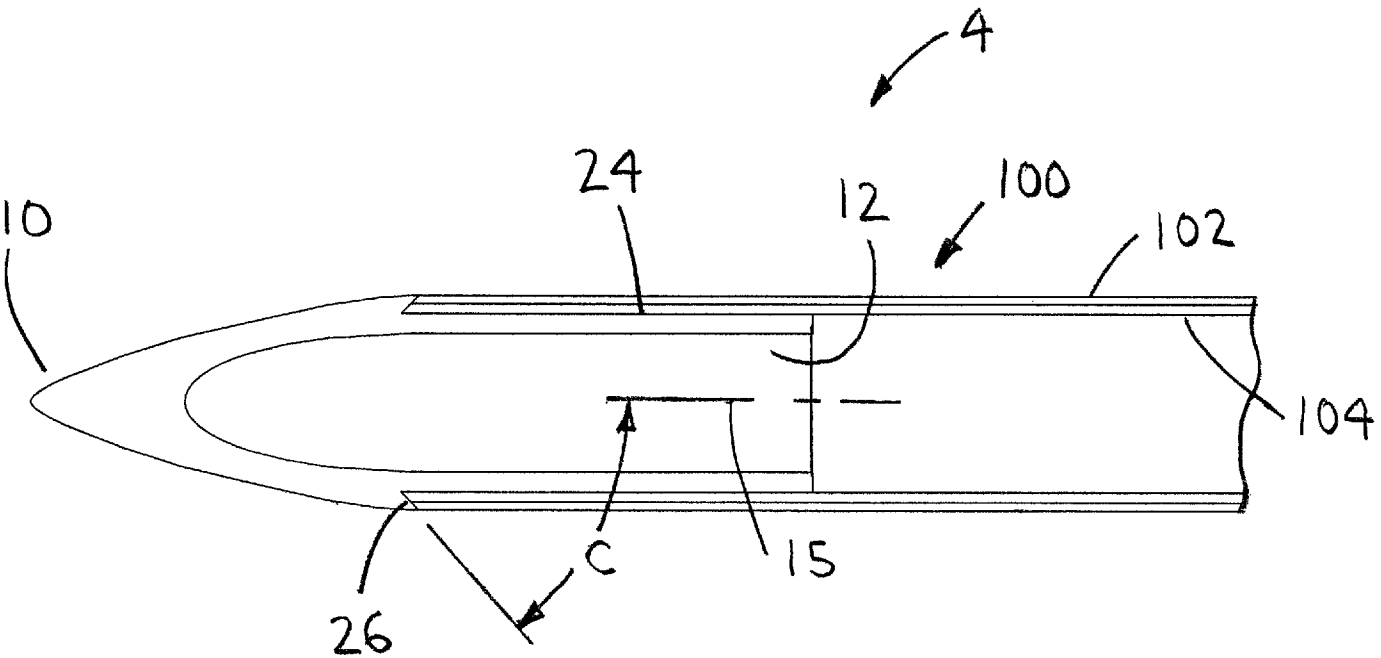
FIG. 4 is a cross sectional view of a fourth embodiment of a field point in accordance with the present invention.

With reference to FIG. 2, a second embodiment of the field point 2 includes the outer undercut 20 and terminating an end of the inner tube diameter 18 with an inner undercut 22. The inner undercut 22 forms an acute angle "B" with a lengthwise axis 15 of the field point 2. The acute angle "B" is preferably 45 degrees, but other acute angles may also be used. An end of the inner tube 104 of the double walled arrow shaft 100 is chamfered or tapered to be received by the inner undercut 22. A third embodiment of the field point 3 does not include the outer undercut 20 or the inner undercut 22. The end of the outer tube diameter 16 and the end of the inner tube diameter 18 are substantially perpendicular to the lengthwise axis 15 of the field point 3. With reference to FIG. 4, a fourth embodiment of the field point 4 includes only an inner tube diameter 24, which is sized to receive an inner diameter of the inner tube 104 of the double walled arrow shaft 100. An end of the inner tube diameter 24 is terminated with a single undercut 26. The single undercut 26 forms an acute angle "C" with the lengthwise axis 15 of the field point 4. The acute angle "C" is preferably 45 degrees, but other acute angles may also be used. One end of the outer tube 102 and the inner tube 104 are flush with each other. The one end of the inner and outer tubes are chamfered or tapered to be received by the single undercut 26.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A field point for a double walled arrow shaft comprising:

a field point includes a target point formed on one end and a weight reduction cavity formed into an opposing end;

an outer tube diameter is formed on an outer diameter of said field point, said outer tube diameter is sized to receive an inner diameter of an outer tube of a double walled arrow shaft; and an inner tube diameter is formed on said outer tube diameter, an end of said inner tube diameter starts adjacent said end of said outer tube diameter and between said end of said outer tube diameter and said opposing end of said field point, wherein said inner tube diameter is sized to receive an inner diameter of the inner tube of the double walled arrow shaft.

2. The field point for a double walled arrow shaft of claim 1 wherein:

an end of said outer tube diameter starts at substantially a middle of said field point.

3. The field point for a double walled arrow shaft of claim 1 wherein:

said weight reduction cavity includes a bullet shaped end.

4. The field point for a double walled arrow shaft of claim 1 wherein:

an end of the inner tube is located inside the outer tube, such that the end of the inner tube is recessed inside the outer tube.

5. The field point for a double walled arrow shaft of claim 1 wherein:

said weight reduction cavity extends substantially all of a length of said field point.

6. A field point for a double walled arrow shaft comprising:

a field point includes a target point formed on one end and a weight reduction cavity formed into an opposing end;

an outer tube diameter is formed on an outer diameter of said field point, said outer tube diameter is sized to receive an inner diameter of an outer tube of a double walled arrow shaft, an outer undercut is formed at an end of said outer tube diameter, said outer undercut forms an acute angle with a lengthwise axis of said field point, wherein an end of the outer tube is chamfered to be received by said outer undercut; and an inner tube diameter is formed on said outer tube diameter, wherein said inner tube diameter is sized to receive an inner diameter of the inner tube.

7. The field point for a double walled arrow shaft of claim 6 wherein:

an end of said outer tube diameter starts at substantially a middle of said field point.

8. The field point for a double walled arrow shaft of claim 6 wherein:

an inner undercut is formed at said end of said inner tube diameter, said inner undercut forms an acute angle with a lengthwise axis of said field point.

9. The field point for a double walled arrow shaft of claim 6 wherein:

said weight reduction cavity includes a bullet shaped end.

10. The field point for a double walled arrow shaft of claim 6 wherein:

an end of the inner tube is located inside the outer tube, such that the end of the inner tube is recessed inside the outer tube.

11. The field point for a double walled arrow shaft of claim 6 wherein:

said weight reduction cavity extends substantially all of a length of said field point.

12. The field point for a double walled arrow shaft of claim 6 wherein:

said acute angle is about 45 degrees.

13. A field point for a double walled arrow shaft comprising:

a field point includes a target point formed on one end and a weight reduction cavity formed into an opposing end; and a tube diameter is formed on an outer diameter of said field point, said tube diameter is sized to receive an inner diameter of an inner tube of a double walled arrow shaft, an undercut is formed at an end of said tube diameter, said undercut forms an acute angle with a lengthwise axis of said field point, wherein an end of the inner tube and an outer tube of the double walled arrow shaft are chamfered to be received by said undercut.

14. The field point for a double walled arrow shaft of claim 13 wherein:

an end of said tube diameter starts at substantially a middle of said field point.

15. The field point for a double walled arrow shaft of claim 13 wherein:

said weight reduction cavity includes a bullet shaped end.

16. The field point for a double walled arrow shaft of claim 13 wherein:

said weight reduction cavity extends substantially all of a length of said field point.

17. The field point for a double walled arrow shaft of claim 13 wherein:

said acute angle is about 45 degrees.

* * * * *